United States Patent [19]

Gordy

[11] 4,267,662

[45] May 19, 1981

[54] INFLATABLE MATING BUILDING BLOCKS

[75] Inventor: Peter Gordy, Spring Valley, N.Y.

[73] Assignee: Gordy International, Inc., New York, N.Y.

[21] Appl. No.: 13,018

[22] Filed: Feb. 21, 1979

[51] Int. Cl.[3] ..... A63H 33/08; A63H 3/06

[52] U.S. Cl. ..... 46/25; 46/88

[58] Field of Search ..... 46/25, 87, 24, 23, 16, 46/17, DIG. 1, 88, 89, 90

[56] References Cited

U.S. PATENT DOCUMENTS

| | | | |
|---|---|---|---|
| 383,071 | 5/1888 | Richardson | 46/25 |
| 2,731,768 | 1/1956 | Harrowe | 46/87 |
| 2,972,833 | 2/1961 | Grutta | 46/25 |
| 3,451,882 | 6/1969 | Propoggio | 46/87 |
| 3,941,383 | 3/1976 | Clarke | 46/DIG. 1 |

*Primary Examiner*—Gene Mancene

*Attorney, Agent, or Firm*—Steinberg & Raskin

[57] ABSTRACT

Inflatable toy apparatus of the building block type includes an inflatable member having side surfaces formed of flexible plastic sheet material which, upon inflation, defines a polyhedron and, in the disclosed preferred embodiment, a block or rectangular-shaped hexahedron. Connector elements are provided on the side surfaces of the inflatable block member in a manner such that a plurality of such inflatable members can be detechably interconnected to any one of a variety of ways by a child to construct structures of various amusing configurations. The inflatable members are preferably interconnected while in their deflated condition and subsequently are inflated using a pump or other suitable means. The connector elements are preferably integrally formed with the side surfaces of the inflatable member.

4 Claims, 13 Drawing Figures

FIG. 1
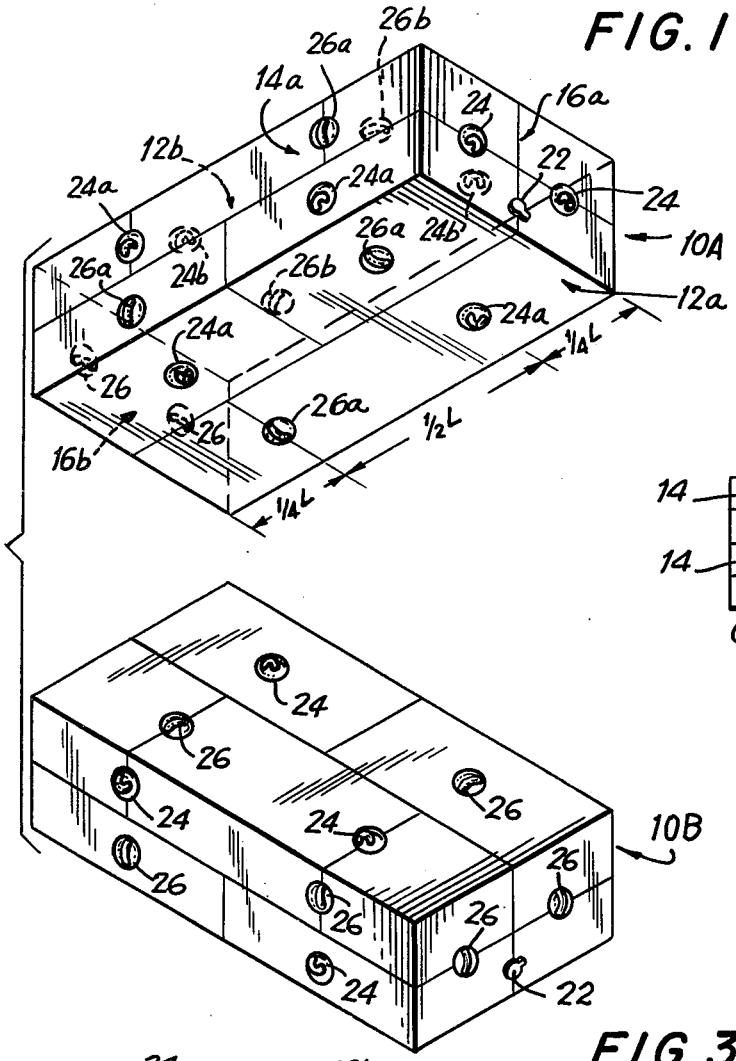
FIG. 2
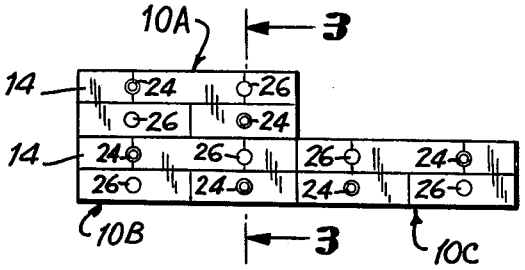
FIG. 3
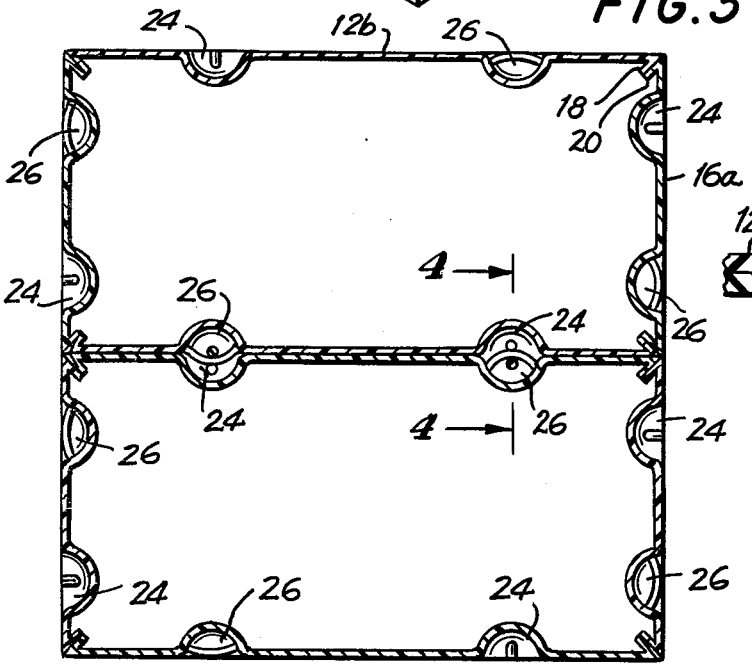
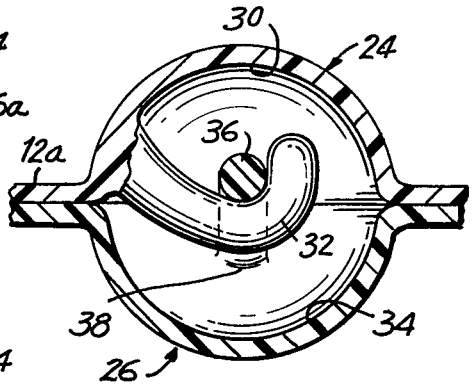
FIG. 4

FIG. 5
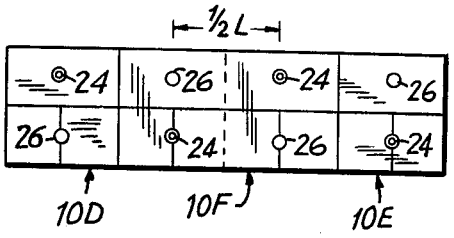
FIG. 6
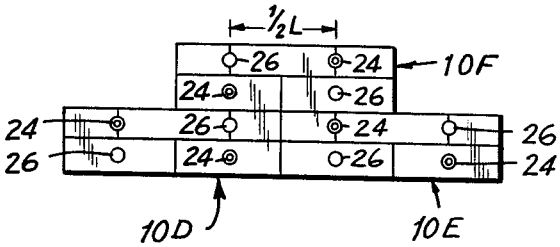
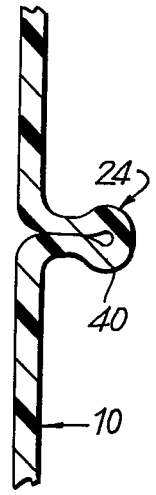
FIG. 7a
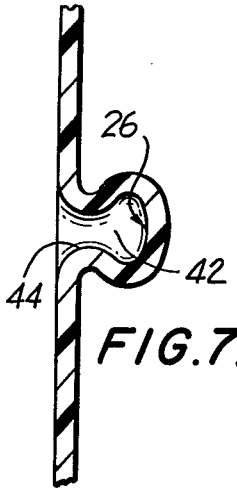
FIG. 7b
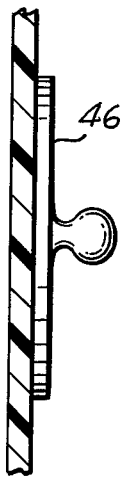
FIG. 8a
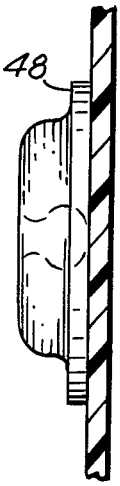
FIG. 8b
FIG. 10
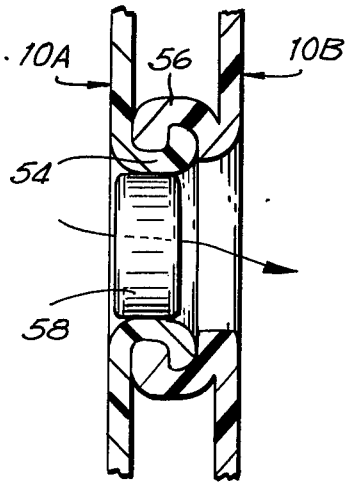
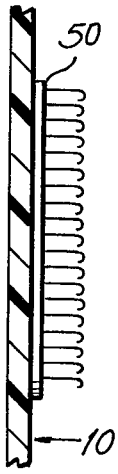
FIG. 9a
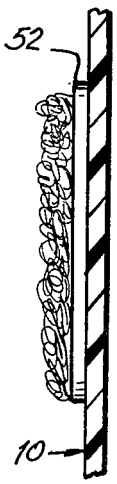
FIG. 9b

INFLATABLE MATING BUILDING BLOCKS

BACKGROUND OF THE INVENTION

This invention relates generally to toy apparatus, and more particularly, to toy apparatus of both the plastic inflatable type and of the building block type.

There are presently available a multitude of toy products of the building block type. Most conventional building block toys comprise rectangular-shaped members formed of wood or the like adapted to be placed in a free standing manner one upon the other during use. These toys have the disadvantage that where only gravity forces are relied upon to hold the blocks in place, the structures built of such blocks are not always stable, especially where several blocks are stacked one upon the other. Further, such structures generally cannot be moved from one place to another.

Although most building block type toys are of this type, several available building block toys comprise building blocks which are provided with means for detachably interconnecting a plurality of such blocks in various configurations so that a child may use his imagination to construct relatively rigid and stable structures and objects of various types. More particularly, conventional building blocks incorporating means for positively interconnecting a plurality of such block usually are formed of rigid material, such as rigid plastic, and are of relatively small size. The size of such blocks is limited generally for the reason that children in the age group for which such blocks are intended for use, namely in the age group of between three and twelve years, have a tendency to throw their playthings. Thus, should the building blocks which, as mentioned above, are formed of rigid plastic material, be of a larger size, household items may be damaged by such improper use of the toy.

It is well known that children enjoy constructing structures and objects on a large scale, approaching life-size, such as walls, club houses, etc. However, currently available building block toys are not especially suited for such use in that such building blocks, when constructed of sufficiently large size to enable such construction, are dangerous for the reason discussed above. Furthermore, such conventional building blocks are not provided with means for detachably interconnecting the same as a unit in a manner which would permit the child to construct structures and objects of various configurations which are relatively rigid and stable.

SUMMARY OF THE INVENTION

Accordingly, one object of the present invention is to provide a new and improved building block toy apparatus.

Another object of the present invention is to provide a new and improved building block toy apparatus including means for positively interconnecting a plurality of blocks so that a child can construct unitary structures or objects which are relatively stable.

Still another object of the present invention is to provide a new and improved building block toy apparatus where the blocks are relatively large in size and yet are completely safe in use, even if thrown or otherwise misused.

Briefly, in accordance with the present invention, these and other objects are attained by providing a building block toy apparatus where the blocks comprise inflatable members. More particularly, each block comprises an inflatable member formed of flexible plastic sheet material which, upon inflation, defines a polyhedron and, in the disclosed preferred embodiment, defines a rectangular hexahedron. Connector means are appropriately provided on side surfaces of the inflatable block member in a manner such that a child, preferably in the age group of from three to twelve years, can detachably interconnect a plurality of the inflatable block members in any one of a variety of configurations. The inflatable block members are preferably interconnected in their deflated condition and are then subsequently inflated.

It is thus seen that by virtue of their inflated structure, the building blocks can be manufactured having a relatively large size, with dimensions, upon inflation, on the order of twelve to eighteen inches in length and six to nine inches in height and depth, while still being completely safe and non-destructive, even when thrown or otherwise misused by the child.

Various types of connector elements for interconnecting the inflatable block members are disclosed. Such connector elements are preferably integrally formed from the plastic sheet material which defines the inflatable block member. Such connector elements include male and female elements, such as hook and eye elements, protrusions and recesses, and others. Further, the connector elements are arranged in suitable patterns on the walls of the inflatable block members so that the latter may be interconnected in a variety of ways to enable the child to utilize his imagination to the greatest extent in constructing a multitude of different structures and objects. According to one embodiment, unidirectional valves are provided in at least some of the connector elements which allow for inflation of the interconnected block members through the injection of air through only a single inflatable block member.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which:

FIG. 1 is a schematic view in perspective of a pair of inflatable block members according to the present invention illustrating one manner of interconnection therebetween;

FIG. 2 is a schmatic front view of a plurality of interconnected block members of the present invention illustrating one manner of interconnection;

FIG. 3 is a section view taken along line 3—3 of FIG. 2;

FIG. 4 is a section view taken along line 4—4 of FIG. 3 illustrating one embodiment of the connector elements according to the present invention;

FIG. 5 is a plan view of plurality of inflatable block members according to the present invention illustrating another manner of interconnection thereof;

FIG. 6 is a front view of the interconnected inflatable block members illustrated in FIG. 5;

FIGS. 7*a* and 7*b* are partial sections of a pair of inflatable block members illustrating another embodiment of the connector elements;

FIGS. 8*a* and 8*b* is a view similar to FIG. 7 illustrating yet another embodiment of the connector elements;

FIGS. 9*a* and 9*b* is a view similar to FIG. 7 illustrating yet another embodiment of the connector elements; and FIG. 10 is a partial section view illustrating cooperating connecting elements of a pair of interconnected inflatable block members wherein a one-way valve is provided in one of the connector elements.

DESCRIPTION OF THE PREFERRED EMBODIMENT

Referring now to the drawings wherein like reference characters designate identical or corresponding parts throughout the several views, and more particularly to FIGS. 1–3, the present invention comprises an inflatable block member, generally designated 10 which, in the illustrated preferred embodiment, has in its inflated condition the shape of a rectangular hexahedron. It is understood, however, that it is within the scope of the present invention to provide the block member with the shape of any polyhedron, i.e., any solid object defined in its entirety by substantially planar side surfaces. It should be further understood in this connection that due to the inflatable nature of block member 10 and the particular materials from which it is constructed, described below, the central portion of a side surface thereof may have a tendency to bow slightly outwardly upon inflation. However, such bowing will be minimized for a particular side surface upon an additional inflatable block member being interconnected thereto along that side surface.

As best seen in FIG. 1, the inflatable block member 10 is defined by three pairs of opposed, parallely extending, side surfaces 12*a, b,* 14*a, b* and 16*a, b,* respectively, the two pairs of side surfaces 12*a, b* and 14*a, b* comprising longitudinally extending side walls and the pair of side surfaces 16*a, b* comprising transversely extending end walls.

Each side surface of inflatable block member 10 comprises a sheet of flexible plastic material, such for example as polyvinylchloride, polyethylene, polyvinylacetate or the like.

The peripheral edge regions of each of the side surfaces are sealed in an appropriate manner to the corresponding edge regions of four of the other side surfaces in a manner apparent from the drawings. Preferably the four edge regions of each side surface are creased and folded inwardly and sealed to similarly inwardly folded mating edge regions of each of the four side surfaces to which it is attached. Thus, referring to FIG. 3, an edge region 18 of side wall 12*b* is folded inwardly into the interior of inflatable block member 10A and sealed along its initially outwardly facing surface to the initially outwardly facing surface of an edge region 20 of end wall 16*a*. All of the edge regions of each side surface are similarly sealed to the respective edge regions of the other side surfaces. The sealing may be accomplished in any one of several known ways such, for example, as heat sealing, adhesive sealing, etc.

An inflation valve 22, schematically illustrated in FIG. 1, is integrally formed in one of the side surface of inflatable block member 10. The inflation valve 22 is preferrably formed so as to have a nipple portion to which a pump device can be connected for purpose of inflation of the block member 10. Alternatively, an inflation valve of the type conventionally used with inflatable devices, such as beach balls and the like may be utilized. In this case, the inflatable block member 10 must be inflated by the child blowing into the same.

According to an important feature of the present invention, connector elements are provided on the various side surfaces of the inflatable block member 10 so that a plurality of identical block members can be mutually interconnected in a detachable fashion. By this provision, any structure which a child may build utilizing the present invention will be of unitary nature and, additionally, be relatively stable. It is also desirable for the connector elements to be provided in a manner so as to permit the block members 10 to be interconnected in at least two distinct configurations, namely, in a "stacked" relationship wherein each block member directly overlies another block member, such as shown in FIG. 2, or in a "staggered" relationship wherein the inner halves of two laterally adjacent block members are overlapped by an upper block member, such as shown in FIGS. 5 and 6.

To this end, according to the illustrated preferred embodiment of the present invention, the side and end walls 14, 16 and 18 are provided with male and female connector elements 24, 26 respectively schematically illustrated in FIGS. 1, 2, 5 and 6, which are suitably arranged to provide the capability of interconnecting the inflatable block members 10 in either of the relationships described above. It should be understood, however, that the particular arrangement of connector elements illustrated and described herein merely comprises several possible arrangements and, in fact, it is within the scope of the invention to provide connector elements which permit the interconnection of the inflatable block members in only one of the two relationship described above.

Thus, referring to FIG. 1, a pair of male connector elements 24*a, b* and a pair of female connector elements 26*a, b* are provided on each of the side walls 12*a, b,* 14*a, b* in a manner so as to define the corners of an imaginary rectangle, the male and female connector elements of each pair being located at diagonally opposed corners of the rectangle. Further, the pattern of male and female connector elements provided on each one of a pair of opposed side walls is a mirror image of the pattern of connector elements provided on the other one of that pair. For example, referring to the inflatable block member 10A of FIG. 1, the male connector elements 24*a* provided on side wall 12*a* are directly aligned and located in opposed relationship to the male connector elements 24*b* provided on side wall 12*b*. Similarly, the female connector elements 26*a* provided on side wall 12*a* are directly aligned with and located in opposed relationship to the female connector elements 26*b* provided on side wall 12*b*. Similarly, the pattern of connector elements provided on opposed side walls 14*a* and 14*b* are mirror images of each other.

Further, it is noted that where the longitudinal dimension of the side walls have a value of L, each connector element on each side wall formed in the pattern described above is preferrably located at a distance of $\frac{1}{4}$L from the respective transverse end wall to which it is most proximate and at a distance from the respective side wall which forms a right angle thereto which is constant for all the connector elements. In this manner, the longitudinal distance between pairs of adjacent male and female connectors 24, 26 on each side wall is $\frac{1}{2}$L.

Each of the transverse end walls is provided with an indentical pair of connector elements of the opposite type from those provided on the opposed end wall. Thus, referring to the inflatable block member 10A illustrated in FIG. 1, end wall 16*a* is provided with a pair of male connector elements 24 while end wall 16*b* is provided with a pair of female connector elements 26.

Having described the pattern of connector elements of the preferred embodiment in detail it will now be readily seen that the inflatable block members 10 can be interconnected in either of the two manners described above. Thus, the block members can be interconnected in a stacked relationship as shown in FIGS. 1 and 2 or in a staggered relationship as shown in FIGS. 5 and 6. In this connection, as mentioned above, it is intended for the block members to be interconnected while in their deflated condition and then subsequently inflated.

Referring to FIGS. 1 and 2 which illustrate the stacked type of interrelationship, the block member 10A may be oriented so that upon inflation the male and female connector elements on side wall 12*a* will align with respective female and male connector elements on the corresponding side wall of inflatable block member 10B. It will be seen that the inflatable block member 10A is diametrically reversed in space with respect to block member 10B in order to accomplish this connection. Of course, it is understood that as many inflatable block members may be vertically stacked and interconnected in this manner as desired and practical in any given situation. It is further noted that the vertically aligned walls of vertical adjacent block members 10 will present alternating male and female connector elements in the vertical direction. It is clear that one or more block members or vertically extending stacks of block members formed in this manner may be interconnected to each other in the longitudinal direction through the connector elements provided on the end walls. Thus, as seen in FIG. 2, a block member 10C may be interconnected to block 10B as shown. It should also be noted that two or more block members may be interconnected to each other in the transverse direction (not shown) through the connector elements provided on the vertically extending side walls, e.g., side walls 14*a, b*.

Referring to FIGS. 5 and 6 which illustrate the staggered type of interrelationship, blocks 10D and 10E are interconnected to each other in the longitudinal direction through the connector elements provided on their end walls. By virtue of the spacing of the connector elements provided on the side walls as described above, it is seen that the length of the imaginary rectangle defined by the inner end pairs of male and female connector elements on each of the block members 10D and 10E, designated by the arrow 28, is ½L which, of course, is precisely the spacing of the connector elements on the contiguous face of a block member 10F which overlies the lower two block members in staggered relationship. Thus, the blocks may be interconnected in the staggered form as shown in FIGS. 5 and 6 and it is readily apparent that walls, corners and other structures can be constructed in this manner. It is noted that when the inflatable block members are interconnected in this staggered relationship as shown, each block member is oriented in space in the same manner as the others. Again, the block members may be interconnected transversely in the same manner as described above in connection with FIGS. 1 and 2.

According to another feature of the invention, the connector devices are preferably formed integrally with the flexible plastic sheet material of each side surface defining the inflatable block member. This may be accomplished during the molding process by which the inflatable block member is constructed. Such a provision has the advantage of materially reducing costs and labor involved in the manufacture of the invention.

It is also desirable to form the connector elements in a manner such that they are substantially recessed interiorly of the plane of the side surface of the inflatable block member in which they are provided. Such provision is advantageous since it is desirable to avoid protrusions which may be injurious if the toy is improperly used.

Referring now to FIGS. 3 and 4, one embodiment of cooperating male and female connector elements 24, 26 is illustrated. Thus, referring to FIGS. 3 and 4, a male connector element 24 formed in a side wall of an inflatable block member comprises an inwardly formed concave or substantially dome-shaped portion 30 integrally formed with the side surface on which it is provided (shown in FIG. 4 as side wall 12*a*) and a hook-shaped member 32 integrally formed therewith. The female connector element 26 is similarly formed having an inwardly directed concave or dome-shaped portion 34 integrally formed with the side surface of the inflatable block member 10. A bridging portion 36 is integrally formed at the mouth of the dome-shaped portion 34 so as to define therewith an opening or eye 38 through which the hook-shaped member 32 is adapted to pass.

The hook and eye members described above are formed so that when the inflatable block member 10 is in its inflated condition but unconnected to any other inflatable block members, the hook-shaped member 32 and bridging portion 36 are substantially recessed interiorly of the respective side surfaces of the block member in which they are formed. Of course, it is understood that these members may be substantially flush with or even slightly protrude beyond the plane of the respective side surfaces but that they are essentially recessed as described above. Since the inflatable block members are intended to be interconnected in their deflated condition, it is a simple matter for the child to deform the respective dome-shaped portions 30, 34 of the hook and eye members, respectively, so that the hook-shaped member 32 will pass into the eye area 38 to interconnect the block members. Of course, upon such connection, the hook-shaped member 32 and bridging portion 36 will be deformed exteriorly of their respective side surfaces as best seen in FIG. 4. Thus, in this manner, male and female connector elements are provided which are integrally formed with the side surfaces of the inflatable block member and in a manner wherein they are normally recessed interiorly thereof.

Referring now to FIGS. 7*a* and 7*b*, another embodiment of the male and female connector elements 24, 26 is illustrated. In this embodiment, a bulbous shaped protrusion 40 is integrally formed on the respective side surface of the inflatable block member 10, protrusion 40 comprising the male connector element 24. Protrusion 40 may be formed of a thickened area of the flexible plastic sheet material of which the side surface of the block member 10 is constructed. Protrusion 40 is preferably formed in a hollow manner so as to be expandable to at least some extent upon inflation of block member 10. The female connector element 26 in this embodiment merely comprises a recess 42 formed in the side surface of block member 10 having a reduced diameter mouth area 44. As is apparent, the interconnection of the respective inflatable block members 10 is accomplished by inserting the bulbous shaped protrusion 40 into the recess 42 while the block members are in their deflated condition. Upon inflation of the block members, the protrusion 40 expands within recess 42 thereby locking the block members in interconnected relationship. Thus, male and female connecting devices are provided which are integrally formed with the side surfaces of the respective block members.

Other connector elements may be utilized in connection with the present invention which are not integrally formed with the side surfaces of the inflatable block members. Thus, referring to FIGS. 8*a* and *b*, conventional male and female snap fastener elements 46, 48, respectively may be suitably affixed to the side surfaces of the block members, such as by adhesive or other means. Additionally, as shown in FIGS. 9*a* and *b*, hook and loop type strip fasteners may be utilized. Such strip type fasteners are available under the trademark Velcro. As seen in FIGS. 9*a* and *b*, Velcro hook element 50 may be adhesively affixed to a side surface of inflatable block member 10 and a Velcro loop element 52 may be similarly affixed to appropriate locations on the inflatable block member 10. The hook and loop elements 50, 52, of course, comprise the male and female connector elements of the present invention.

As mentioned above, each of the inflatable block members 10 is preferrably provided with an inflation valve so that subsequent to interconnection in their deflated condition, the individual inflatable block members 10 may be inflated by a pump or other means. Alternatively, means may be incorporated in the connector elements of the inflatable block members so as to provide the capability of inflating the entire interconnected unitary structure through a single inflatable block member. Thus, at least one male and female connector element in each inflatable block member may be constructed as shown in FIG. 10. More particularly, the side surfaces of each block member may be molded in the manner of FIG. 10 with outwardly formed lips 54, 56, the latter being formed in a manner so as to retain their shape. Each of the lips 54, 56 define an annular groove into which the end portion of the other lip is lockingly received upon interconnection of the respective block members. The annular opening defined by lip 54 has located therewithin a one way valve 58 of conventional construction which allows a unidirectional flow of gas, for example from block member 10A to block member 10B after a predetermined minimum internal pressure is reached in the block member 10A. In this manner, upon inflating block member 10A by pump or other means, a point will be reached whereupon additional air being pumped into its interior will flow into the interior of block member 10B. Similar connector devices are, of course, provided which intercommunicate the interior of inflatable block member 10B with additional interconnected block members so that in this manner, continued inflation of block member 10A will result in the eventual inflation of the entire assembly.

Obviously, numerous modifications and variations of the present invention are possible in the light of the above teachings. Therefore, it is understood that within the scope of the appended claims, the invention may be practices otherwise than as specifically disclosed herein.

What is claimed is:

1. Building block toy apparatus comprising:

an inflatable member having side surfaces formed of flexible plastic sheet material, said member defining, upon inflation, a polyhedron having three pairs of opposed, substantially parallel side surfaces, two of said pairs of side surfaces defining longitudinally extending side walls and the third pair of side surfaces defining transversely extending end walls; and connector means integrally formed on said side and end walls of said inflatable member for detachably fastening at least one additional inflatable member thereto, said connector means formed on each side wall comprising at least one male connector element including a bulbous-shaped protrusion which is expandable upon inflation of said inflatable member and at least one female connector element including a recess defined in said side wall.

2. Building block toy apparatus comprising:

an inflatable member having side surfaces formed of flexible plastic sheet material, said member defining, upon inflation, a polyhedron having three pairs of opposed, substantially parallel side surfaces, two of said pairs of side surfaces defining longitudinally extending side walls and the third pair of side surfaces defining transversely extending end walls; and connector means integrally formed on said side and end walls of said inflatable member for detachably fastening at least one additional inflatable member thereto, said connector element having a one-way valve associated therewith.

3. Building block toy apparatus comprising:

an inflatable block member having side surfaces formed of flexible plastic sheet material, said member defining, upon inflation, a hexahedron defined by three pairs of opposed, substantially parallel side surfaces, two of said pairs of side surfaces defining longitudinally extending side walls having a certain length and the third pair of side surfaces defining transversely extending end walls; and connector means provided on at least said side walls of said inflatable member for detachably fastening at least one additional hexahedron defining inflatable member thereto, said connector means including a pair of female and a pair of male connector elements provided on each of said side walls so as to define the corners of an imaginary rectangle, the male and female connector elements of each pair being located at diagonally opposed corners of said imaginary rectangle and at a distance from an end wall of substantially one-fourth the length of said side walls.

4. Building block toy apparatus as recited in claim 3 wherein the connector elements provided on each pair of opposed side walls are mirror images of each other.

* * * * *